US005357229A

United States Patent [19]

Benton

[11] Patent Number: 5,357,229

[45] Date of Patent: Oct. 18, 1994

[54] METHOD FOR TUNING A MICROSTRIP DEVICE USING A PLASTIC DIELECTRIC SUBSTANCE

[75] Inventor: Robert H. Benton, Mountain View, Calif.

[73] Assignee: Pacific Monolithics, Inc., Sunnyvale, Calif.

[21] Appl. No.: 145,976

[22] Filed: Nov. 1, 1993

[51] Int. Cl.[5] ..... H01P 1/203

[52] U.S. Cl. ..... 333/205; 333/235

[58] Field of Search ..... 333/203, 204, 205, 219, 333/235, 246; 29/593, 600

[56] References Cited

U.S. PATENT DOCUMENTS

| | | | |
|---|---|---|---|
| 3,864,824 | 2/1975 | Watson et al. | 29/593 X |
| 4,243,960 | 1/1981 | White et al. | 333/196 |
| 4,638,271 | 1/1987 | Jecko et al. | 333/205 |
| 4,706,050 | 11/1987 | Andrews | 333/205 |

*Primary Examiner*—Seungsook Ham

*Attorney, Agent, or Firm*—Edward B. Anderson

[57] ABSTRACT

A microstrip filter having a plurality of parallel resonant conductors mounted on a dielectric substrate is tuned by applying a portion of a hot-melt type glue to the filter surface. The glue is melted and then deposited on the conductors and spread across and along the conductors until the filter has a desired frequency response. The glue is then cooled until it becomes solid.

13 Claims, 2 Drawing Sheets

METHOD FOR TUNING A MICROSTRIP DEVICE USING A PLASTIC DIELECTRIC SUBSTANCE

BACKGROUND OF THE INVENTION

1. Field of the Invention

This invention relates to microstrip devices, such as antennas and filters, and in particular to a method for tuning such devices by applying a plastic dielectric substance on the surface of the device.

2. Related Art

Microwave devices designed to have coupled line structures, particularly antennas and filters, depend primarily on odd mode interline coupling capacitance for setting of the edge frequency of the pass band. Below this frequency the device rejects unwanted signals. These devices are typically implemented on planar media, such as fiber-glass epoxy circuit boards.

The dielectric constant of fiber-glass epoxy circuit boards is not well controlled. Variation in the dielectric constant of the circuit board changes the odd mode interline capacitance. With filters, this causes shifting of the pass band edge. There is thus a need to reduce the variation in odd-mode capacitance, or at least to compensate for shifts in the odd-mode capacitance from a design or target value.

Various ways are known for tuning a microstrip device after it is constructed and found to have odd-mode capacitance that varies from the design value. For instance, an electrically conductive plate may be suspended over the device. The closer the plate is to the device, the greater the coupling. This, however, is an expensive solution.

Techniques have also been used that involve positioning a dielectric layer on top of the microstrip device. Jecko et al., in U.S. Pat. No. 4,638,271, discloses placing a dielectric plate having one of a variety of shapes on the microstrip conductors of a filter. Once the plate is attached, adjustments are made by making cuts with a scalpel until a desired value is obtained, or by adding or removing strips of the dielectric material. Additionally, adjustment may be made by machining away the thickness of the plate or by adding additional layers having the same or different dielectric constant. This technique, though ultimately effective, requires a lot of labor, inventory of dielectric materials, and special apparatus to effect it. It is therefore also expensive and time-consuming to perform.

An alternative approach is to silk-screen one or more layers of a dielectric paint or ink on the microstrip device. This approach, taught by Andrews in U.S. Pat. No. 4,706,050, requires specialized silk-screening equipment, which must be maintained, as well as following a multistep process when more than one layer is required. Further, each layer alters the frequency of tuning of the device by a specific amount, making it difficult to precisely tune the device.

There thus remains a need for a technique for tuning a microstrip device that is simple to perform yet effective for precisely tuning the device.

SUMMARY OF THE INVENTION

These features are provided in the present invention by applying a plastic dielectric substance progressively across the surface of the microstrip device until a desired frequency response is achieved.

In the preferred embodiment of the invention, a method is provided for tuning a microstrip filter having a plurality of parallel resonant conductors mounted on a dielectric substrate. The frequency response of the filter is measured. A portion of a hot-melt glue is heated until it melts. The glue preferably has a dielectric constant greater than that of air and is solid over the operating temperature range of the filter.

A sufficient amount of the melted glue is then deposited on the filter conductors. The melted glue is then spread across and along the conductors while measuring the frequency response of the device. The spreading is terminated when the desired frequency response has been reached. The glue is then cooled until it becomes solid.

This technique thus achieves infinitely selectable tuning in a simple operation. Further, in its preferred form, the dielectric substance is self-adhering to the microstrip device and typically has a dielectric constant that is between that of an epoxy-based circuit board and air.

These and other features and advantages of the present invention will be apparent from the following detailed description of the preferred embodiment of the invention and from the accompanying drawings.

DETAILED DESCRIPTION OF THE PREFERRED EMBODIMENT

Figure 1:
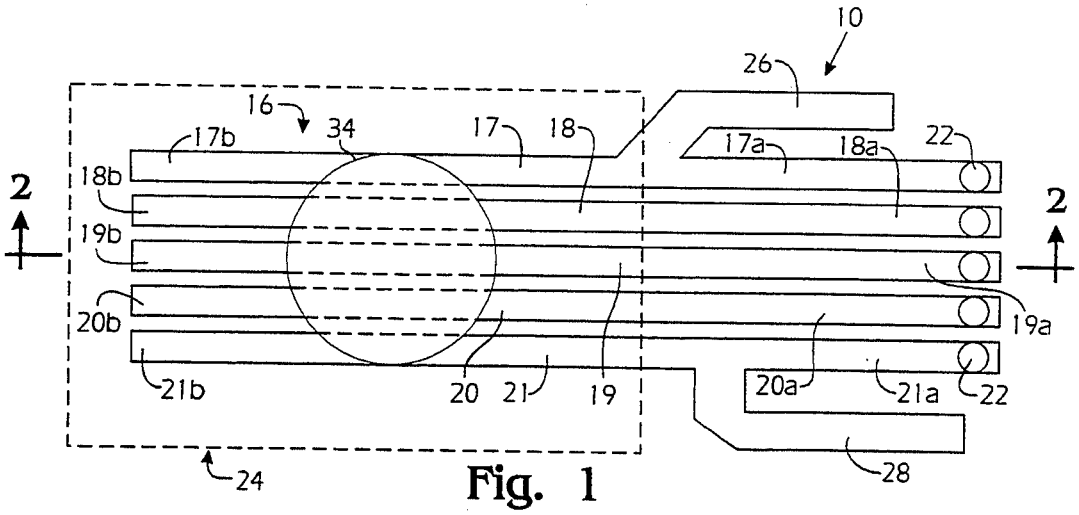
FIG. 1 is a top view of a microstrip filter with hot-melt glue deposited on it according to the invention.
Figure 2:
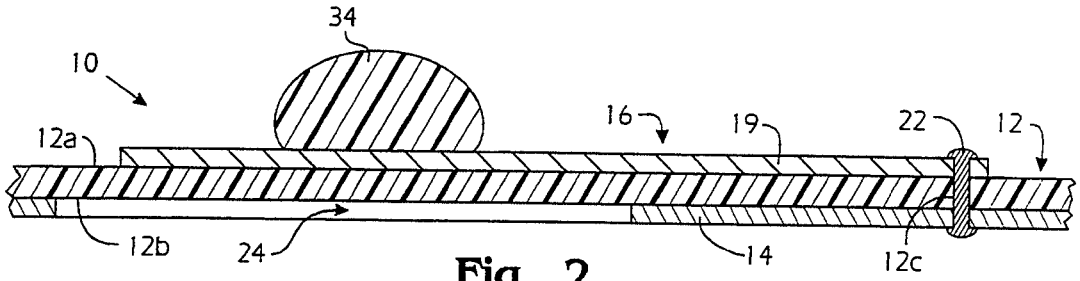
FIG. 2 is a cross-section taken along line 2—2 in FIG. 1.
Figure 3:
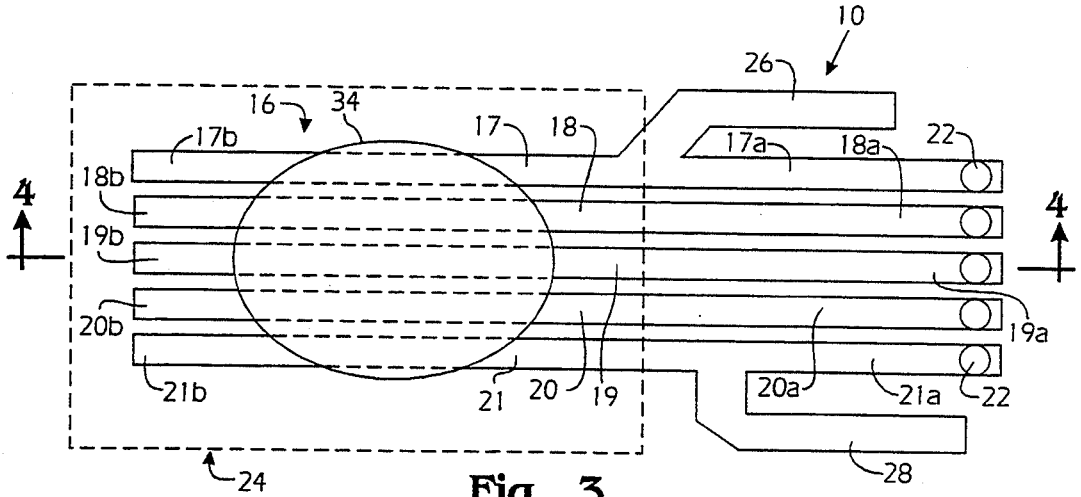
FIG. 3 is a top view of the microstrip filter of FIG. 1 with the hot-melt glue spread across it according to the invention.
Figure 4:
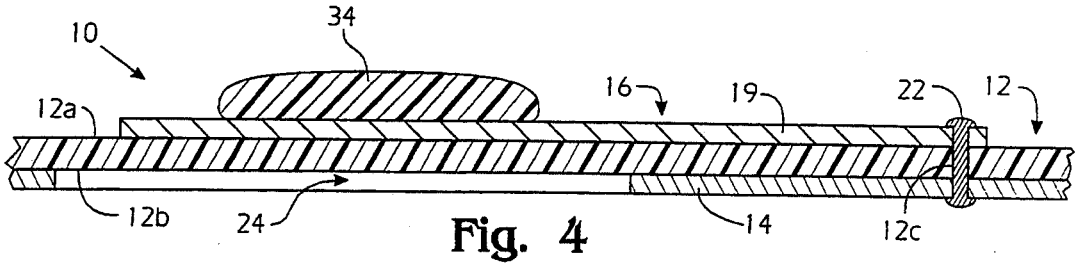
FIG. 4 is a cross-section taken along line 4—4 in FIG. 3.

Referring initially to FIGS. 1 and 2, a microwave microstrip filter 10 for practicing the method of the invention is shown. Filter 10 includes a dielectric substrate 12 having a dielectric constant $\epsilon_r$ and top and bottom faces 12*a* and 12*b*, respectively, as viewed in FIG. 2. A conductive ground plane 14 is disposed on bottom face 12*b* of the substrate.

A set 16 of parallel microstrip conductors 17, 18, 19, 20 and 21 are disposed on top side 12*a* of the substrate. The right ends 17*a*, 18*a*, 19*a*, 20*a* and 21*a* of these conductors, as viewed in the figures, are electrically connected to ground plane 14 by connectors 22 extending through via holes, such as via hole 12*c* in the substrate, as shown in FIG. 2. The other ends 17*b*, 18*b*, 19*b*, 20*b* and 21*b* are physically, and therefore electrically spaced from the ground plane.

As shown in dashed lines in FIG. 1, and in the cross section of FIG. 2, filter 10 preferably includes a nonconductive cavity 24 in ground plane 14 below and adjacent to conductor ends 17*b*–21*b* . As is described in copending U.S. patent application having Ser. No. 08/020,044 filed on Feb. 19, 1993, the size of region 24 determines the general filter characteristics desired.

A microstrip input port 26 is connected to conductor 17. Correspondingly, a microstrip output port 28 is connected to conductor 21.

Since the ground plane is preferably replaced with air having an effective dielectric constant of 1, the even mode dielectric constant is substantially diminished in this region, whereas the odd mode dielectric constant is hardly affected. Other nonconductive materials could also be used to fill the cavity. The pass band is thereby moved above the stop band, as is shown in the curves 30 and 32 of FIG. 5. These curves were generated for a filter having conductors that are all 0.0275 inches wide by 0.8200 inches long. This length corresponds to $\frac{1}{4}\lambda$ in air for a resonant frequency of about 3.6 GHz. The space between the conductors is 0.0125 inches. The preferred length of the air cavity 24 is about 0.6 inches along the length of the conductors. It is seen that the stop band of curve 32 is below about 2.0 GHz and the pass band is above about 2.2 GHz, with a dramatic transition between these frequencies.

The dielectric constant of the substrate affects the pass and stop bands differently, as the pass band is most influenced by the even mode dielectric constant and the stop band is most influenced by the odd mode dielectric constant. The cavity causes the pass band to be above the stop band, and the insertion loss is reduced due to the presence of air beneath the conductors. This raises the unloaded Q. Moreover, the frequency of the even mode becomes less dependent on the dielectric constant of the substrate, enhancing production tolerances.

The odd mode dielectric constant remains approximately $\frac{1}{2}(\epsilon_r + 1)$. To reduce the odd mode dielectric constant further, the gap between the conductors needs to approach or exceed the substrate thickness. This, however, is generally of limited use because the size of the filter is increased and the mathematical description of the odd mode dielectric constant becomes complicated. Even so, the loss is optimized by lowering the odd mode dielectric constant, lowering current density, and thus raising the odd mode conductor and dielectric Q.

Figure 5:
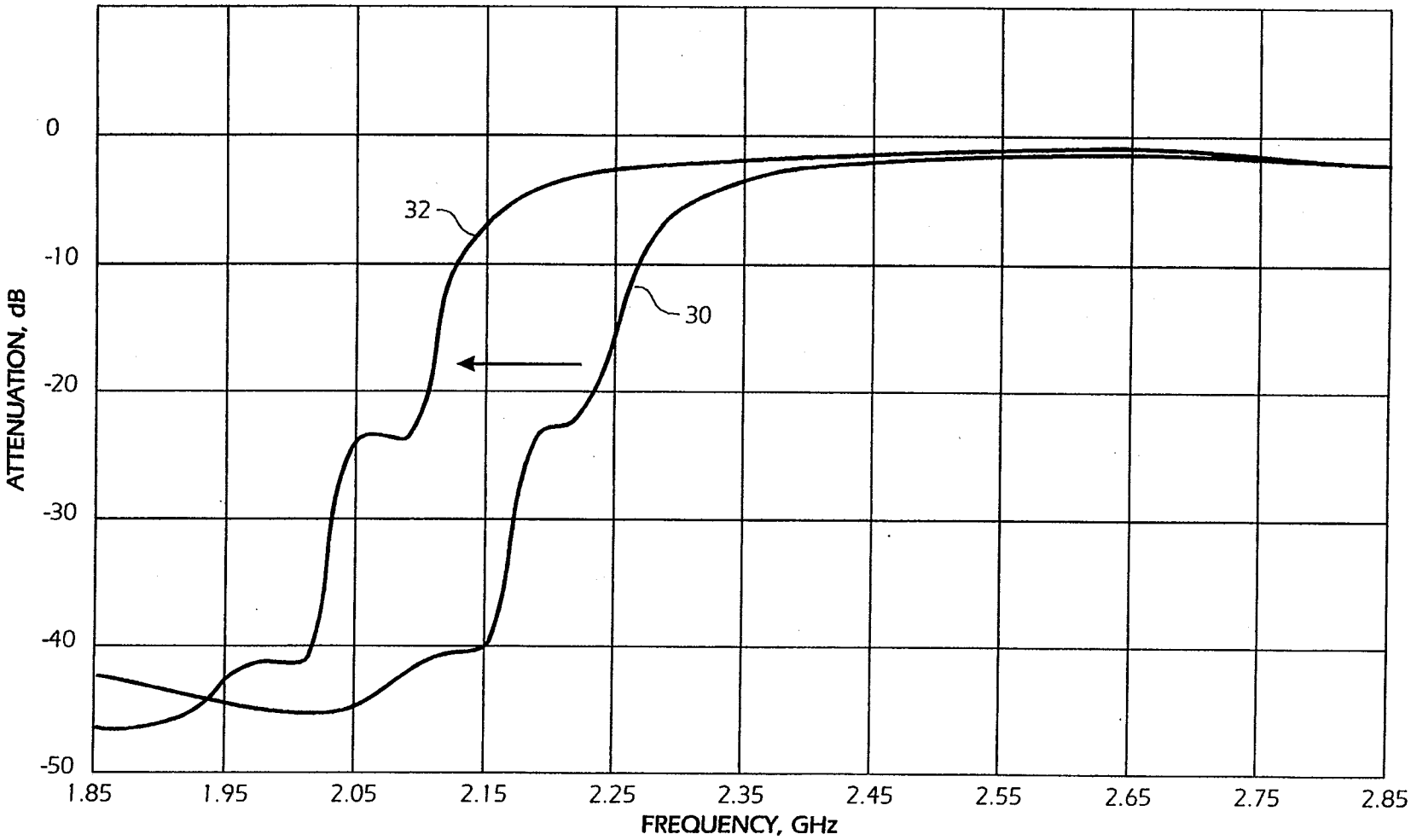
FIG. 5 is a graph showing frequency response curves of the filter of FIG. 1 both before and after performing the method of the invention.

These factors then result in design filter characteristics, represented by curve 32 in FIG. 5. The actual characteristics of a filter as produced may be different than the design characteristics due to variations in the manufacturing process, as is represented by curve 30. Important among these variations is the effective dielectric constant of substrate 12. The substrate is typically formed of a combination of fiber-glass and epoxy. The dielectric constant of such media is not well-controlled. This is due to inconsistencies in the distribution of the fiber-glass in the epoxy and in the components making up the epoxy. Because of variations in the dielectric constant, the odd mode interline capacitance varies. One of the results of this is a shifting of the filter band edge.

Since the odd-mode interline capacitance varies over a range of values, the filter preferably is designed for a capacitance on the higher end of the range. Then, if the capacitance is actually lower and filter 10 has, as a result, a higher low-end cut-off frequency than the design value, the interline capacitance is adjusted according the following method of the present invention to move the cut-off frequency to the design value.

The odd-mode interline capacitance is due to a combination of the capacitances between the microstrip conductors in the substrate and in the air over and between the conductors. As discussed above, the capacitance due to the substrate is variable and is not specifically controlled. This is compensated for by varying the interline capacitance above and between the conductors.

In the preferred method of practicing the invention, the filter is connected to an appropriate, commercially available signal generator and a scalar analyzer. A frequency sweep is applied to the filter and a plot of the power attenuation versus frequency, similar to that shown by curve 30 in FIG. 5, is obtained.

A determination is made initially about the amount of frequency adjustment that is necessary to bring the filter to the design frequency. If some adjustment is required, a glue known commercially as hot-melt glue is heated in an appropriate apparatus such as a conventional hot-melt-glue gun. A small portion of the glue 34 is then deposited on top of the conductors. The glue should be about as wide as the set of conductors and several times the thickness of the conductors. An apparatus could also be devised that would dispense an automatically regulated amount of glue.

While observing a display of the frequency response of the filter, the glue is spread over and between the conductors with an appropriate tool, such as an X-ACTO TM knife, until the frequency response of the filters matches a desired or design frequency response. The resultant frequency response may be as shown by curve 32 in FIG. 5.

Glue 34 is a conventional hot melt glue, such as one sold commercially by 3M Company or by Sears, Roebuck and Company, and has a dielectric constant greater than 2. This is much more than the air it replaces. The odd mode dielectric constant is thereby raised from about 2.7 to 3.4. The interline capacitance is thereby increased dramatically with the presence of the glue. The greater the area over which the glue is spread, the greater the capacitance and the lower the cutoff frequency of the filter.

Filter 10 has a maximum design operating temperature of less than 60° C. The hot-melt glue exists in a solid phase below about 60° C. and is in a semisolid or plastic phase at about 60° C., and becomes progressively more liquid the more it is heated. The glue exists in a liquid phase at 150° C. Thus, at around 60° C., as the melted glue is cooling, it is in a plastic or spreadable phase that allows it to be manipulated with a tool, yet is neither runny or solid. After the glue is spread and the desired frequency response achieved, the glue is cooled until it reaches a solid phase. The glue then adheres to the surface of the filter and holds its shape and position. It is preferred that enough glue be applied for it to have a thickness of a least two times the conductor thickness after it is spread over the desired surface area of the filter.

An advantage of the hot melt glues is that it is an adhesive, so that it is self-adhering to the filter surface. Other substances could also be used so long as there is some way to secure them in position on the filter. However, the added substance must not creep over time, in order to maintain the filter cut-off frequency. The commercially available hot-melt glue sold by 3M Company has these characteristics inherently.

It is also desirable for the glue not to detract from the temperature stability of the cutoff frequency. It has been found that a filter having the hot-melt glue in fact shows less temperature sensitivity than the filter has without it. Other substances with other characteristics may affect the temperature sensitivity adversely.

It will be apparent to one skilled in the art that variations in form and detail may be made in the preferred method of practicing the invention and it may be used on other microstrip resonant devices without varying from the spirit and scope of the invention as defined in the claims and any modification of the claim language or meaning as provided under the doctrine of equivalents. For instance, filter 10 described above has a ground plane cavity 24. The method of the invention may be performed on any resonant microstrip device, with or without such a cavity. Other substances exhibiting the necessary plasticity may also be used. Further, the applied substance could be applied in a continuous stream until the desired frequency response is achieved, rather than depositing it all at once and then spreading it. The preferred method is thus described for purposes of explanation and illustration, but not limitation.

I claim:

1. A method of tuning a microstrip device comprising a dielectric substrate and having electrically coupled conductors on a surface of the substrate, the method comprising the steps of:

measuring the frequency response of the device; and applying a plastic dielectric substance over a progressively larger surface area of the electrically coupled conductors until the device has a desired frequency response.

2. A method according to claim 1 wherein the step of applying includes the steps of positioning a deposit of the plastic dielectric substance on the electrically coupled conductors, and spreading the deposit of the dielectric substance along the electrically coupled conductors.

3. A method according to claim 2 wherein the dielectric substance is liquid-to-solid phase changeable, and the step of spreading is performed while the dielectric substance is in a semiliquid phase.

4. A method according to claim 3 further comprising, after the step of spreading, changing the phase of the spread dielectric substance to a solid phase.

5. A method according to claim 4 wherein the dielectric substance changes phase according to the temperature of the dielectric substance, and the step of changing comprises cooling the dielectric substance.

6. A method according to claim 5 where the device has a specified operating-temperature range, and the dielectric substance is in the solid phase in the operating-temperature range and is in a semiliquid phase at a temperature above the operating-temperature range, and the step of applying further comprises the step of adhering the dielectric substance to the device.

7. A method according to claim 6 wherein the dielectric substance is an adhesive, and the step of applying further comprises the step of adhering the adhesive, dielectric substance to the device.

8. A method according to claim 1 wherein the dielectric substance is an adhesive and the step of applying further comprises the step of adhering the adhesive dielectric substance to the device.

9. A method according to claim 1 where the device has a specified operating-temperature range, and the dielectric substance is in a solid phase in the operating-temperature range and is in a semiliquid phase at a temperature above the operating temperature range, the method further comprising, after the step of applying, cooling the applied dielectric substance until it changes to a solid phase.

10. A method according to claim 9 wherein the dielectric substance is an adhesive, and the step of applying further comprises the step of adhering the adhesive dielectric substance to the device.

11. A method of tuning a microstrip filter having a plurality of parallel resonant conductors mounted on a dielectric substrate, the method comprising the steps of:

measuring the frequency response of the filter;

heating a portion of a hot-melt type glue until it melts, the glue having a dielectric constant greater than that of air;

depositing on the plurality of conductors a deposit of the melted glue;

spreading the deposit of melted glue across and along the conductors until the filter has a desired frequency response; and cooling the glue until it becomes solid.

12. A method according to claim 11 where the filter has a specified operating-temperature range, and the glue is solid in the operating-temperature range, add wherein the step of heating comprises heating the glue to a temperature above the operating-temperature range, and the step of cooling comprises cooling the glue to a temperature in the operating-temperature range.

13. A method according to claim 11 where the conductors have a known thickness and wherein the step of spreading includes spreading the glue to a thickness that is at least as thick as the conductors.

* * * * *